US005928576A

United States Patent [19]

Zimmermann

[11] Patent Number: 5,928,576

[45] Date of Patent: Jul. 27, 1999

[54] CAP-SENSITIVE WATERGEL EXPLOSIVE COMPOSITION PRODUCTION PROCESS

[75] Inventor: Leon Michael Zimmermann, Johannesburg, South Africa

[73] Assignee: Dantex Explosives (Proprietary) Limited, South Africa

[21] Appl. No.: 08/817,142

[22] PCT Filed: Oct. 10, 1995

[86] PCT No.: PCT/GB95/02390

§ 371 Date: Aug. 1, 1997

§ 102(e) Date: Aug. 1, 1997

[87] PCT Pub. No.: WO96/11172

PCT Pub. Date: Apr. 18, 1996

[30] Foreign Application Priority Data

Oct. 11, 1994 [ZA] South Africa ..... 94/7917

[51] Int. Cl.[6] ..... C06B 21/00; C06B 45/00; F42B 3/00

[52] U.S. Cl. ..... 264/3.6; 264/3.5; 86/20.12; 102/288; 102/289

[58] Field of Search ..... 102/288, 289; 86/20.12, 20.15; 264/3.5, 3.6; 149/2

[56] References Cited

U.S. PATENT DOCUMENTS

| | | | |
|---|---|---|---|
| 3,431,155 | 3/1969 | Dunglinson et al. | 149/47 |
| 3,471,346 | 10/1969 | Lyerly | 149/47 |
| 3,765,964 | 10/1973 | Wade | 149/2 |
| 3,770,522 | 11/1973 | Tomic | 149/2 |
| 4,207,125 | 6/1980 | Grant | 149/109.4 |
| 4,380,482 | 4/1983 | Sandell | 149/21 |
| 4,486,495 | 12/1984 | Matsushita et al. | 428/266 |
| 4,555,280 | 11/1985 | Levinthal | 149/109.6 |
| 4,585,495 | 4/1986 | Honeyman et al. | 149/2 |

FOREIGN PATENT DOCUMENTS

| | | | |
|---|---|---|---|
| 0622346 | 11/1994 | European Pat. Off. | C06B 47/14 |
| 1071385 | 6/1967 | United Kingdom | C06B 1/04 |
| 1170944 | 11/1969 | United Kingdom | C06B 1/04 |
| 2257135 | 1/1993 | United Kingdom | C06B 23/04 |

*Primary Examiner*—Peter A. Nelson
*Attorney, Agent, or Firm*—Ladas & Parry

[57] ABSTRACT

A watergel explosive composition is described which contains an oxidiser salt, a sensitiser, a thickener, a crosslinking agent, a fuel and less than 8%, by mass, of the composition of water. The explosive composition is cap sensitive in packages or cartridges having a diameter of about 26 mm or less at temperatures below about 5° C. when detonated with a standard number 6 strength detonator. The explosive composition does not require a supplementary sensitisor or a perchlorate salt to achieve this cap sensitivity. A method of producing the explosive composition by separately preparing a thickened aqueous phase and a dry phase, and allowing the thickened phase to stand for a period of time before the mixing of the two phases, as well as explosive paper cartridge containing the watergel explosive composition, are also described.

6 Claims, No Drawings

CAP-SENSITIVE WATERGEL EXPLOSIVE COMPOSITION PRODUCTION PROCESS

BACKGROUND OF THE INVENTION

This invention relates to an explosive composition of the type known as a watergel or a slurry-type composition and to a process for manufacturing this explosive composition.

Watergel or slurry explosives are widely used because they perform well and are relatively safe to make, store and use. The high water content of watergel or slurry explosives has, however, necessitated that they be cartridged in plastic packaging. This has drawbacks in that it has presented difficulties inter alia with the proper loading of the explosive into boreholes.

In South African Patent Application No. 94/2573, an improved watergel or slurry explosive is described which has a sufficiently low water content that it is dry to the touch and can therefore be packaged in standard waxed paper cartridges of the type used for packing dynamite or other nitroglycerine sensitized explosives without causing the paper cartridge to disintegrate. The hydrogel explosive compositions described in South African Patent Application No. 94/2573 are capable of initiation by a number six strength detonator in small diameter cartridges and they are thus said to be "cap sensitive in small diameter" cartridges.

The cap sensitivity of an explosive composition is a measure of the reliability of detonation of the explosive composition in the field. The lower the temperature at which an explosive composition is cap sensitive, the less prone it is to transient desensitisation and the more likely it is to detonate reliably in the field. Also, the smaller the diameter of the cartridge, the more difficult it is to achieve cap sensitivity at a low temperature. A perchlorate salt or pigment aluminium is incorporated into the explosive compositions described in South African Patent Application No. 94/2573 to make them cap sensitive in small diameter at temperatures of 5° C. or less as these components are known to lower the temperature at which an explosive composition is cap sensitive.

While the inclusion of a perchlorate salt or pigment aluminium in an explosive composition improves cap sensitivity of the composition and thus enhances its reliability, there are certain drawbacks to the inclusion of these components.

In certain countries, such as South Africa, perchlorate salts and pigment aluminium are expensive. Perchlorate salts are also very reactive.

Therefore, while the inclusion of a perchlorate salt enhances the cap sensitivity of a composition containing it, it also increases the frictional and impact or shock sensitivity of the composition. This makes the composition relatively less safe to make, store, transport and use. However, it has not been possible to do away with the perchlorate salt or pigment aluminium and still achieve low temperature cap sensitivity in these low water watergel compositions when packaged in small diameter.

SUMMARY OF THE INVENTION

According to the invention a watergel explosive composition is provided which contains an oxidiser salt, a sensitiser, a thickener, a crosslinking agent, a fuel and less than 8%, by mass, of the composition, of water and which is cap sensitive in packages having a diameter of about 26 mm or less at temperatures below about 5° C. when detonated with a standard number six strength detonator, characterised in that it does not require a supplementary sensitiser or a perchlorate salt to achieve this cap sensitivity. The water content is preferably less than 6%, by mass, of the composition. More preferably, the water content is less than 5%, by mass, of the composition.

In the specification what is meant by a "standard number six strength detonator" is a 6D aluminium instantaneous electric detonator manufactured by AECI Explosives Limited, or in international terminology, a "standard number six strength detonator" is a detonator which has about 350 mg of PETN in the base charge.

The oxidiser salt is preferably a nitrate of ammonia or of an alkali or alkaline earth metal, or mixture of these. Although it is not necessary to include a perchlorate salt in the low water watergel explosive compositions of the invention, it may be useful in certain specialised applications to include a perchlorate salt as the, or as part of, the oxidiser salt component, although this would decrease the margin of safety of the composition.

More preferably, the oxidiser salt is unmilled ammonium nitrate prills on their own or in conjunction with nitrates of alkali or alkaline earth metals, preferably sodium nitrate.

The sensitiser preferably consists of more than 50% by weight of one or more water soluble compounds of oxygen balance more positive than −150%, selected from the salts of nitric, chloric and perchloric acid with acyclic nitrogen bases, having no more than two hydrogen atoms bonded to each basic nitrogen atom and up to three carbon atoms per basic nitrogen atom, and the salts of nitric, chloric and perchloric acid with a phenyl amine. The sensitiser may be a water soluble sensitiser and may be an alkylamine nitrate or an alkanolamine nitrate. Preferred examples are monomethylamine nitrate, ethanolamine nitrate, diethanolamine nitrate, triethanolamine nitrate, dimethylamine nitrate, hexamine nitrate, ethylenediamine nitrate, laurylamine nitrate and mixtures of these.

The preferred sensitiser is monomethylamine nitrate, either on its own or in combination with other sensitisers.

The fuel may be a product of vegetable origin, such as a starch, flour, sawdust or woodmeal, rubber, coal or sugar or molasses or a vegetable oil.

Alternatively, it may be a product derived from crude oil. It may be a solid hydrocarbon, such as ground rubber and recycled plastic waste, or a liquid hydrocarbon such as glycol, waxes, ethylene glycol or other alcohols, oils and waxes. It may also be a metallic fuel, such as aluminium, which is added to enhance the performance of the explosive.

The type of fuel used is not critical and is usually determined by cost considerations. The quantity of fuel that is added is determined by the oxygen balance desired in the explosive composition.

The thickener may be a natural thickener, such as guar gum, accacia gum or galactomannin or starch. Alternatively, it may be a biosynthetic product such as xanthan gum. Further alternatively, it may be a synthetic polymer, such as polyacrylamide.

The watergel explosive composition may also contain a density reducing agent, which may be a solid void-containing material, such as perlite, glass microspheres or plastic microspheres or expanded polystyrene or a chemical additive which is capable of generating gas in situ, for example sodium nitrite.

According to another aspect of the invention a process for manufacturing a watergel explosive composition comprises the steps of:

preparing a thickened aqueous phase of water, at least a portion of a water soluble sensitiser, at least a portion of a thickener, a portion of an oxidiser salt, optionally a portion of a crosslinking agent and optionally a portion of a fuel;

preparing a dry phase of the remaining oxidiser salt, any remaining thickener, any remaining crosslinking agent, any remaining fuel, and any remaining water soluble sensitiser separately;

allowing the thickened aqueous phase to stand for a period of time;

mixing the two phases; and reducing the density of the mixture by mixing the composition in such a way so as to incorporate gas into it or by adding a density reducing agent.

The thickened aqueous phase may contain all of the crosslinking agent. Alternatively, the dry phase may contain all of the crosslinking agent. Further alternatively, the thickened phase may contain a portion of the crosslinking agent and the dry phase may contain a portion of the crosslinking agent.

The period of time for which the thickened phase is allowed to stand is preferably at least about five minutes, more preferably at least about ten minutes.

The oxidiser salt is preferably unmilled porous ammonium nitrate either on its own or in conjunction with sodium nitrate, potassium nitrate or calcium nitrate.

The thickened aqueous phase preferably comprises between about 25% and 80%, by mass, of the composition.

More preferably, it comprises more than about 30%, by mass, of the composition.

Most preferably, it comprises about 60%, by mass, of the composition.

According to yet another aspect of the invention an explosive cartridge comprises a paper cartridge and a watergel explosive composition of the invention contained within the paper cartridge. Preferably, the explosive cartridge has a diameter below about 26 mm.

According to yet another aspect of the invention a method of cartridging a watergel explosive composition comprises the step of filling a paper cartridge with the watergel explosive composition of the invention using a cartridging machine of the type used to cartridge nitro-glycerine sensitised explosives.

Paper in this specification can be defined as any cellulosic material which is substantially free of any plastics material.

DETAILED DESCRIPTION OF THE INVENTION

A watergel explosive composition which is reliably cap sensitive in small diameter formulations (including those in packages or cartridges below 26 mm) which can be cartridged in paper and which can be fired with a standard number 6 strength detonator at temperatures of 5° C. or less without the need for the addition of a supplementary sensitiser or a perchlorate salt is described. This is entirely unexpected as until now it has not been possible to do away with the supplementary sensitiser and a perchlorate in watergel compositions of the low water type and still to achieve a low temperature cap sensitivity in small diameter cartridges. The absence of a supplementary sensitiser and a perchlorate salt greatly reduces the friction and impact or shock sensitivity of the watergel compositions of the invention. It has therefore been possible to produce a watergel composition with all the packaging advantages of the watergels described in South African Patent Application No. 94/2573 but with enhanced safety and cost advantages.

It has been possible to formulate these low temperature, small diameter cap sensitive watergel compositions by using the unique production process of the invention. The process involves a two step procedure of producing a thickened aqueous phase and a dry phase and allowing the thickened phase to stand for a certain period of time before adding the dry phase to it. The thickened phase should preferably be allowed to stand for at least about 5 minutes. It has been found that good results are obtained when the thickened phase is allowed to stand for about 10 minutes. If the watergel explosive composition is prepared with any crosslinker in the thickened phase, the time for which the thickened phase is allowed to stand may have to be limited to less than about 60 minutes as it could prove difficult to incorporate once crosslinking has taken place.

Without wishing to be bound by theory, it is thought that the use of the two- step procedure for producing the watergel composition allows a better re-growth of mixed crystals of water soluble sensitiser and oxidiser which are more reactive and thus which render the explosive cap sensitive. The further step of allowing the thickened phase to stand further promotes this crystal re-growth. When the thickened phase is then mixed with the dry phase, the matrix of mixed crystals provides the sensitivity necessary to initiate the entire mass of the composition.

The thickened aqueous phase comprises water, at least a portion of a water soluble sensitiser, at least a portion of a thickener, a portion of an oxidiser salt, optionally a portion of a crosslinking agent and optionally a portion of a fuel. The dry phase contains the remaining oxidiser salt, any remaining thickener, any remaining crosslinking agent, any remaining fuel and any remaining water soluble sensitiser. It was also unexpectedly found that it is not necessary to prepare a clear solution of oxidiser salt in the solution of water soluble sensitiser in the thickened phase. It will be seen that in South African Patent Application No. 94/2573 a clear solution was formed in the thickened phase and to achieve this less than 30% of the water soluble components of the composition were incorporated into the thickened phase. It has now been found that as much as 60% or more of the water soluble components of the composition can be included in the thickened phase and that an effective composition results even if there is undissolved material in this phase. It is to be noted that as long as the dry phase contains at least some of the oxidiser salt, the other non-soluble components may be mixed into the thickened phase without adversely affecting the re-growth of mixed crystals of water soluble sensitiser and oxidiser.

The discovery that a low temperature cap sensitive composition can be formed without incorporating pigment aluminium, which is very expensive, or a perchlorate salt, which is also expensive and very reactive, is an important one. Apart from the cost saving, the absence of perchlorate salts improves the impact or shock sensitivity of the composition. This can be seen from the table set out below where four explosive compositions, produced in the examples which follow, were tested by Naschem (A division of Denel (Pty) Limited) for impact sensitivity on a Julius Peters Impact Sensitivity Apparatus and for friction sensitivity on a Julius Peters Friction Sensitivity Apparatus.

| Sample number | 1 | 2 | 3 | 4 |
|---|---|---|---|---|
| Example number | 5 | 8 | 1 | 4 |
| Monomethylamine nitrate | 17.6% | 17.6% | 20.0% | 16.0% |
| Ammonium nitrate | 67.6% | 73.5% | 71.6% | 69.4% |
| Potassium perchlorate | 6.0% | 0 | 0 | 0 |
| Sodium perchlorate | 0 | 0 | 0 | 5.2% |
| Ground rubber | 2.8% | 1.9% | 1.8% | 3.0% |
| Organic Thickener | 1.6% | 1.6% | 1.6% | 1.6% |
| Pigment aluminium | 0 | 1.0% | 0 | 0 |
| Water | 4.4% | 4.4% | 5.0% | 4.8% |

In a Julius Peters Impact Sensitivity Apparatus the sensitivity to impact of explosives is tested by a Fallhammer method where each sample is subjected to the action of a falling hammer of different masses from different heights.

The parameters to be determined are the height of fall at which a sufficient amount of impact energy is transmitted to the sample for it to decompose or to explode. The sample is placed in a confinement device which consists of two coaxial cylinders placed one on top of the other and guided by a steel ring.

The impact sensitivity test results are summarised in table 1:

| | Height | |
|---|---|---|
| Sample | 1500 mm | 2000 mm |
| 1 | No ignition (20 trials) | 1 Ignition out of 6 trials |
| 2 | No ignition (10 trials) | 2 Ignitions out of 6 trials |
| 3 | — | No ignition (10 trials) |
| 4 | No ignition (10 trials) | 1 Ignition out of 6 trials |

All tests were conducted with a 5 kg hammer.

Sample 1 includes potassium perchlorate, Sample 2 includes pigment aluminium and Sample 4 includes sodium perchlorate. At a height of 2000 mm each of Samples 1, 2 and 4 were ignited. It will be seen that the sample containing pigment aluminium (Sample 2) was the most sensitive. The composition containing none of these (Sample 3) did not ignite, thus indicating the degree to which the removal of perchlorate salts and/or pigment aluminium decreases the impact sensitivity over a composition containing it.

None of the samples were found to be friction sensitive.

In the United States, the relevant regulations preclude the use of explosives containing perchlorates in coalmines. The so-called "permissable" explosives, therefore, do not contain perchlorates. The process of the invention for manufacturing a watergel explosive composition allows for the production of a composition (without perchlorate salts) suitable for use in mines with hazardous atmospheres, for example coalmines. By the addition of suitable halide salts to the explosive compositions of the present invention, typically sodium chloride (NaCl), potassium chloride (KCl), or ammonium chloride ($NH_4Cl$), suitable "permissable" or "permitted" explosives are obtained.

It has also been found that when using the process of the present invention it is possible to use unmilled ammonium nitrate prills and still to achieve low temperature, small diameter cap sensitivity. Obviating the need to mill the ammonium nitrate eliminates a messy and time consuming step in the production of watergel explosive compositions.

When the density of the explosive composition is reduced by using chemical gassing as the voiding means, a certain amount of gassing takes place in the package or cartridge after cartridging has taken place. With a composition packed in plastic this is not normally a problem since the package is strong enough to contain any gas generated, and thus any expansion in the volume of the composition, without rupturing. However, with a composition packed in paper, gassing in the package is a real problem since the gassing causes the composition to expand and increase in volume. This pushes the crimps, which close the ends of the cartridge, open. This occurs because a paper cartridge is not positively sealed in any way and it relies simply on the folds of paper to remain closed.

When milled ammonium nitrate is used, and the composition is chemically gassed, the problem is exacerbated because few interstices are present in the composition before the gassing to accommodate the gas. In producing the low water paper packaged watergels of SA Patent 94/2573, where milled ammonium nitrate is used together with chemical gassing, it was found that unless a degree of underfilling of the cartridge was allowed, the crimps on at least one of the ends opened on standing for 24 hours.

It has now been found with the present composition, where unmilled ammonium nitrate prills are used, that by selecting a ratio of dry phase to thickened phase, sufficient interstices are left between the prills that the composition can be packed into cartridges, without the need to underfill the cartridges. The thickened phase then expands into the interstices between the prills while the gassing process continues in the cartridge, without the crimps at the end of the cartridge opening at all. The proportions of the various ingredients and in particular the presence of sodium nitrate in the formulation dramatically affects the final rheology of the product and thus allows one to vary the texture of the product to suit the particular packaging equipment that it is intended to use.

The invention will now be described in more detail with reference to the following examples.

EXAMPLE 1

In the mixer bowl of a Kenwood Chef fitted with a "K" blade (here called a planetary mixer) was placed 550 parts of porous ammonium nitrate prills, 9 parts of guar gum, 27 parts of ground rubber, 1.5 parts of adipic acid and 0.21 parts of potassium pyroantimonate. These ingredients were thoroughly mixed and left in the mixer bowl under the planetary mixer. (This mixture is the dry phase.)

Into a mixer bowl fitted with a propeller agitator (Hydolph stirrer) was placed 375 parts of monomethylamine nitrate solution of 80% concentration at 80° C. To this hot methylamine nitrate solution was added 1.8 parts of thiourea, the agitator was turned on and 434 parts of porous ammonium nitrate was added followed, 30 seconds later, by a mixture of 90 parts of porous ammonium nitrate and 15 parts of guar gum.

After mixing for about 2 minutes, the vortex from the agitator disappeared and mixing was continued for another 30 seconds.

This mixture (which is the thickened phase) was set aside for 10 minutes.

In a separate container was weighed 3 parts of a 15% sodium nitrite solution.

After the 10 minutes referred to above the thickened phase was added to the dry phase and mixed in the planetary mixer at speed 2. After mixing had proceeded for 30 seconds, the sodium nitrite solution was added and mixing was continued for a further 30 seconds. The resulting product was packaged in 25 mm waxed paper cartridges. These cartridges fired at 5° C. with a No. 6 strength detonator. When tested on a Julius Peters Impact sensitivity Apparatus no detonations were recorded in 10 trials from 2000 mm with a 5 kg hammer.

EXAMPLE 2

In this case exactly the same formulation was prepared as that used in Example 1 but the thickened phase was added to the dry phase immediately on completion of the thickened phase. In other words the thickened phase was not allowed to stand for 10 minutes prior to addition of the thickened phase to the dry phase.

The rest of the mixing procedure was identical.

This formulation fired at room temperature (about 20° C.) but failed at 5° C. in 38 mm diameter when tested with a No. 6 strength detonator. In 25 mm diameter it failed at room temperature.

This example has been included for purposes of comparison. It will be noted that, unlike in Example 1, the prepared thickened phase was not allowed to stand for any period of time prior to the addition of the thickened phase to the dry phase. The resulting formulation lacked the cap sensitivity of the composition prepared in accordance with Example 1 where the thickened phase was allowed to stand for 10 minutes.

EXAMPLE 3

Here exactly the same procedure was followed as that used for Example 2 with the only change being that all the porous ammonium nitrate used was milled before use in an attempt to improve the sensitivity.

When tested in 38 mm diameter it was found that the product fired at room temperature (about 20° C.) but failed at 5° C.

This example has also been included for purposes of comparison. It will be noted that, unlike in Example 1 and Example 2, milled porous ammonium nitrate, which should increase the cap sensitivity of the composition, was used. However, as the thickened phase was not allowed to stand for any period of time, the reduced cap sensitivity of the composition of Example 2 could not be improved upon.

EXAMPLE 4

In this case the dry phase was made from 550 parts of milled porous ammonium nitrate, 9 parts of guar gum, 45 parts of ground rubber, 1.5 parts of adipic acid and 0.21 parts of potassium pyroantimonate. These were mixed in the planetary mixer at speed 2 until they were homogeneous.

The thickened phase was made from 300 parts of 80% monomethylamine solution heated to 80° C. into which was dissolved 1.8 parts of thiourea, 90 parts of sodium perchlorate monohydrate, 401 parts of milled porous ammonium nitrate. After mixing for 30 seconds, a mixture consisting of 90 parts of milled porous ammonium nitrate and 15 parts of guar gum was added and mixing was continued at maximum speed until the vortex disappeared and then mixing was continued for a further 30 seconds.

Immediately on completion of the thickened phase it was added to the dry phase and mixed for 30 seconds at speed 2 in the planetary mixer prior to the addition of 3 parts of 15% sodium nitrite solution, after which mixing was continued for a further 30 seconds. The resulting product fired at 5° C. with a No. 6 strength detonator. When tested on a Julius Peters Impact Sensitivity Apparatus 1 detonation was recorded in 6 trials from 2000 mm with a 5 kg hammer.

EXAMPLE 5

This was an analogous mix to that of Example 4, the only change being the substitution of potassium perchlorate for the sodium perchlorate monohydrate used in Example 4. This mix also fired at 5° C. with a No. 6 strength detonator. When tested on a Julius Peters Impact Sensitivity Apparatus 1 detonation was recorded in 6 trials from 2000 mm with a 5 kg hammer.

Examples 4 and 5 have also been included for purposes of comparison. Unlike in Example 2, they include sodium perchlorate and potassium perchlorate respectively. They also include milled porous ammonium nitrate, which enhances the sensitivity of an explosive composition. However, in producing this composition, the thickened phase was not allowed to stand for any period of time. The resulting products were cap sensitive despite the fact that the thickened aqueous phase was not allowed to stand. However, they were also impact sensitive. These examples indicate the sensitising effect of perchlorate salts.

EXAMPLE 6

This was identical to Example 5 but made without milling the porous ammonium nitrate. In this case the product fired at room temperature (about 20° C.) but failed at 10° C.

This example was also included for purposes of comparison. It is to be noted that by not milling the porous ammonium nitrate, the sensitivity of the explosive composition is reduced.

EXAMPLE 7

In this example only 45 parts of potassium perchlorate was used instead of the 90 parts used in Examples 5 and 6. Again the porous ammonium nitrate was not milled. In this case the product failed to fire at 20° C. with a No.6 strength detonator.

This example was also included for purposes of comparison. It is to be noted that by reducing the amount of the perchlorate salt that is included, the cap sensitivity of a watergel explosive composition is substantially negatively affected.

EXAMPLE 8

This was very similar to Example 2 but with the addition of 1% pigment aluminium with a surface area of 20000 $cm^2/g$ to the thickened phase. This formulation fired at room temperature (about 20° C.) with a No. 6 strength detonator but failed at 5° C. When tested on a Julius Peters Impact Sensitivity Apparatus two detonations were recorded in six trials from 2000 mm with a 5 kg hammer.

This example was also included for purposes of comparison. It is to be noted that the inclusion of pigment aluminium did not enhance the cap sensitivity of the composition greatly but enhanced its impact sensitivity, and thus decreased the safety of the composition.

EXAMPLE 9

In this example the dry phase was made from 534 parts of porous ammonium nitrate prills, 42 parts of ground rubber, 3 parts of guar gum, 1.5 parts of adipic acid, and 0.3 parts of potassium pyroantimonate.

The thickened phase was prepared by heating 375 parts of monomethylamine nitrate solution of 80% concentration to 80° C. and adding 1.8 parts of thiourea to this while stirring with a propeller agitator. To this stirring solution was then added 345 parts of porous prilled ammonium nitrate and a pre-mix of 180 parts of sodium nitrate and 21 parts of guar gum. This mixture was mixed for three minutes and then allowed to stand for ten minutes before adding to the dry mix.

After combining the thickened phase and the dry phase in a planetary mixer they were mixed for 30 seconds, after which time 3 parts of a 15% sodium nitrite solution was added and mixing was continued for a further 30 seconds.

This formulation was of a sufficiently low viscosity to be pumpable with a mono pump. The product was still compatible with paper. When packed in cartridges it was found to be cap sensitive in 22 mm diameter at 5° C.

This demonstrates the influence of a change in ingredients on the final rheology of the product. (It is clear when comparing this formulation to that in Example 1 that the only substantive change is the substitution of sodium nitrate for a portion of the ammonium nitrate.)

EXAMPLE 10

In this example the thickened phase was prepared as follows:

1250 parts of an 80% monomethylamine nitrate solution at a pH of between 4.5 and 6.0 and containing 6 parts of thiourea was heated to 80° C.

This hot solution was placed in a mixer fitted with a propeller agitator and the agitator was turned on. To this stirred solution was added 1000 parts of unmilled porous ammonium nitrate followed by a premix, consisting 140 parts of ground rubber, 70 parts of guar gum (type DFS 33, supplied by Hexachem) and 10 parts of a high protein guar (type Gempolym C, supplied by G. M. Associates).

After about 2 minutes of mixing (until the mix had thickened), this thickened solution was placed in the mixer bowl of a planetary mixer and set aside for 10 minutes.

After 10 minutes the bowl was placed under the planetary mixer and the mixer was turned on and a pre-mix of 1930 parts of unmilled porous ammonium nitrate, 600 parts of sodium nitrate, 5 parts of adipic acid and 2 parts of potassium pyroantimonate (sold commercially as Liox by G. M. Associates) was added to the mixer. After mixing for one minute, 11 parts of a 15% sodium nitrite solution was added and mixing was continued for another minute.

The product was then packed, by means of a MONO® pump, into waxed, spirally wound paper tubes.

Product made in this way is capable of initiation by a number 6 strength detonator at 5 ° C. in 25 mm cartridges.

This demonstrates that the order of addition of the sodium nitrate is not critical to the final rheology of the product. This example also demonstrates that it is not necessary to have any thickener in the dry phase.

In all these examples 25 mm cartridges were used. In all these examples no attempt was made first to produce a clear solution of ammonium nitrate in the monomethylamine nitrate solution as is done in the examples of South African Patent Application No. 94/2573. The quantity of ingredients used in the thickened phase and in the dry phase are chosen in order to provide a final product with the required rheology.

Examples 1, 9 and 10 clearly illustrate that using the unique process of the invention, a watergel explosive composition which is cap sensitive in small diameter is obtained even though unmilled oxidiser salt is used and even though no perchlorate or pigment aluminium is added to the composition. What emerges from these examples is the importance of allowing the thickened phase to stand for a period of time before the addition of the dry phase to it. Without wishing to be bound by theory, it is assumed that this results in the formation of mixed crystals of monomethylamine nitrate and ammonium nitrate during the waiting time and this results in the improved cap sensitivity of the compositions.

I claim:

1. A process for manufacturing a cap sensitive watergel explosive composition containing less than 6%, by mass of the composition, of water packaged in a cartridge comprising the steps of:

preparing a thickened aqueous phase of water, at least a portion of a water soluble sensitiser, at least a portion of a thickener and a portion of an oxidiser salt;

preparing a dry phase of the remaining oxidiser salt, any remaining thickener, crosslinking agent, fuel, and any remaining water soluble sensitiser separately;

allowing the thickened aqueous phase to stand for a period of time;

mixing the two phases;

reducing the density of the mixture by incorporating gas into it by adding a chemical density reducing agent; and filing the mixture into a cartridge.

2. A process according to claim 1, wherein the period of time for which the thickened phase is allowed to stand is at least about five minutes.

3. A process according to claim 1, wherein the period of time for which the thickened phase is allowed to stand is at least about ten minutes.

4. A process according to claim 1, wherein the thickened aqueous phase comprises between about 25% and 80%, by mass, of the composition.

5. A process according to claim 1, wherein the oxidiser salt is unmilled porous ammonium nitrate prills or a mixture of unmilled porous ammonium nitrate prills and a nitrate of an alkali or alkaline earth metal.

6. A process according to claim 5, wherein the oxidiser salt is unmilled porous ammonium nitrate and sodium nitrate, potassium nitrate or calcium nitrate.

* * * * *

UNITED STATES PATENT AND TRADEMARK OFFICE

CERTIFICATE OF CORRECTION

PATENT NO: 5,928,576

DATED: July 27, 1999

INVENTOR(S): Zimmermann

It is certified that error appears in the above-identified patent and that said Letters Patent is hereby corrected as shown below:

Column 10, line 36 (claim 1, last line) cancel "filing" and insert --filling--.

Signed and Sealed this

Thirtieth Day of May, 2000

*Attest:*

Q. TODD DICKINSON

*Attesting Officer*

*Director of Patents and Trademarks*